US009857824B1

(12) United States Patent
Lin

(10) Patent No.: US 9,857,824 B1
(45) Date of Patent: Jan. 2, 2018

(54) CALIBRATION OF A RESISTOR IN A CURRENT MIRROR CIRCUIT

(71) Applicant: Taiwan Semiconductor Manufacturing Co., Ltd., Hsinchu (TW)

(72) Inventor: Yu-Tso Lin, New Taipei (TW)

(73) Assignee: Taiwan Semiconductor Manufacturing Company Limited, Hsinchu (TW)

( * ) Notice: Subject to any disclaimer, the term of this patent is extended or adjusted under 35 U.S.C. 154(b) by 52 days.

(21) Appl. No.: 15/180,263

(22) Filed: Jun. 13, 2016

(51) Int. Cl.
*G05F 3/26* (2006.01)
*G05F 3/24* (2006.01)

(52) U.S. Cl.
CPC ..... *G05F 3/262* (2013.01); *G05F 3/24* (2013.01); *G05F 3/26* (2013.01)

(58) Field of Classification Search
CPC ..... G05F 3/24; G05F 3/26; G05F 3/262
See application file for complete search history.

(56) References Cited

U.S. PATENT DOCUMENTS 9,660,647 B2 * 5/2017 Chern ..... H03K 19/0005
2009/0261866 A1 * 10/2009 Shibata ..... G05F 3/262 327/108
2012/0038343 A1 * 2/2012 Takagi ..... G05F 1/561 323/299
2016/0252923 A1 * 9/2016 Nien ..... G05F 3/262 323/313

* cited by examiner

*Primary Examiner* — Jue Zhang
*Assistant Examiner* — Lakaisha Jackson
(74) *Attorney, Agent, or Firm* — Jones Day

(57) ABSTRACT

A reference stage includes a first transistor, a second transistor and a resistor that are connected in series from a voltage rail to a reference load. The resistor has (i) a resistance that is a function of a digital resistance-controlling value, (ii) a first terminal coupled to a gate of the first transistor, and (iii) a second terminal that has a voltage VG2 and is coupled to a gate of the second transistor. A comparator has a first input that is coupled to the resistor's second terminal. A diode-connected reference transistor is connected from the voltage rail to the comparator's second input to apply a voltage VD at the second input. An adjusting circuit adjusts the digital resistance-controlling value to cause VG2 to approach VD until the comparator's output changes state when VG2 reaches VD.

20 Claims, 3 Drawing Sheets

CALIBRATION OF A RESISTOR IN A CURRENT MIRROR CIRCUIT

TECHNICAL FIELD

The present disclosure is directed generally to system including integrated circuits. In particular, the present disclosure relates to system structures including integrated circuits such as current mirror circuits.

BACKGROUND

A current mirror circuit includes (i) a reference stage that provides reference current to a current reference load and (ii) an output stage that outputs supply current to an output load. The current mirror circuit controls the supply current, that is drawn by the output load, to equal the reference current that is drawn by the current reference load.

BRIEF DESCRIPTION OF THE DRAWINGS

Various aspects of the present disclosure will be or become apparent to one with skill in the art by reference to the following detailed description when considered in connection with the accompanying exemplary non-limiting embodiments.

DETAILED DESCRIPTION

Figure 1:
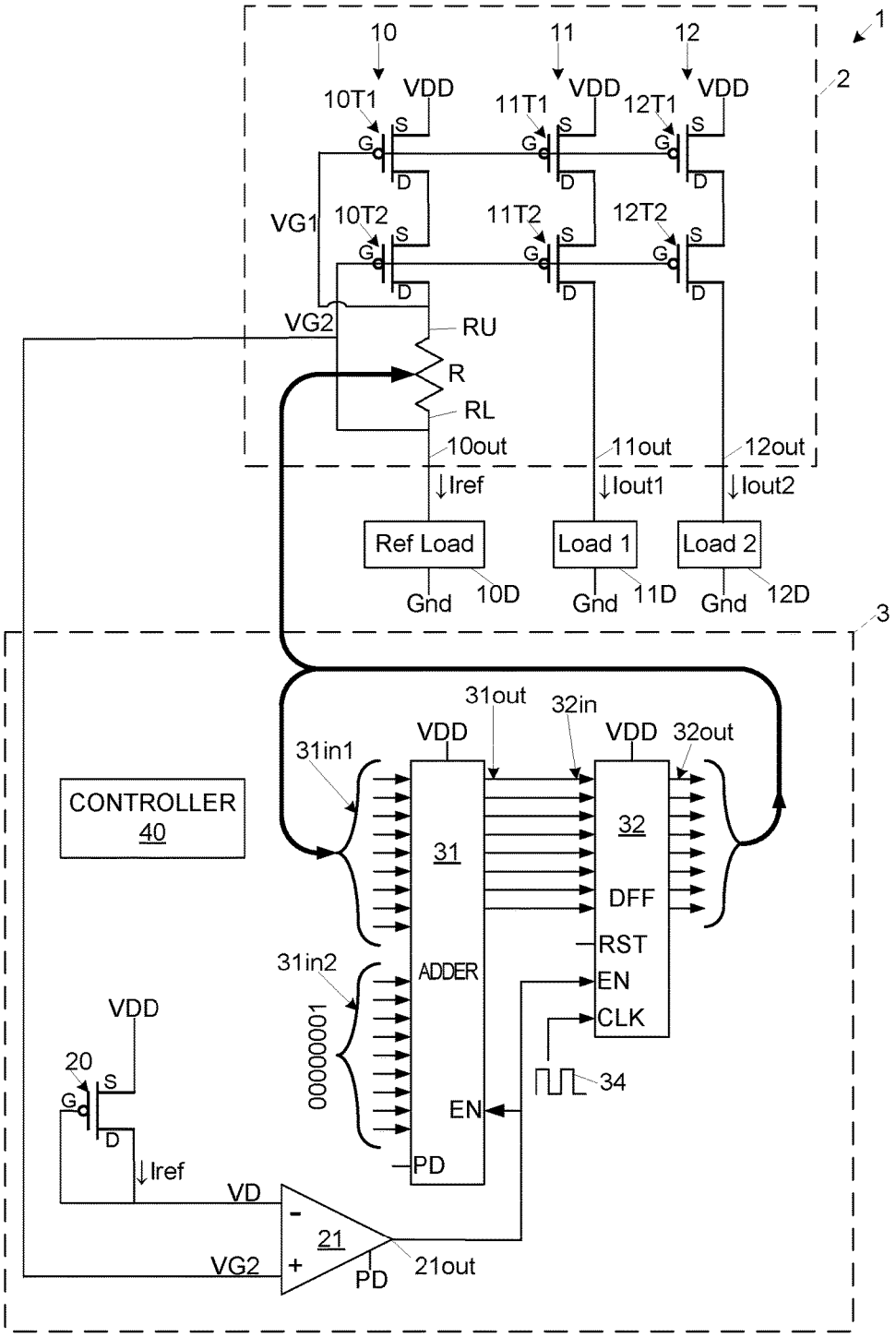
FIG. 1 is a schematic drawing of an example pMOSFET-based self-biasing current mirror system.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In an embodiment, a current mirror includes a reference stage that has first and second transistors and a digitally-controllable resistor, that are electrically connected in series. The resistor has a terminal, at a voltage VG2, coupled to a gate of the second transistor. VG2 is applied to a first input of a comparator. A diode-connected reference transistor outputs a voltage VD to the comparator's second input. An adjusting circuit controls the resistor's resistance to cause VG2 to approach VD until the comparator's output changes state when VG2 reaches VD.

In an embodiment, the adjusting circuit adjusts a digital resistance-controlling value, that is output to the resistor, to cause VG2 to approach and reach VD. The adjusting circuit latches the digital resistance-controlling value when VG2 reaches VD.

FIG. 1 shows an example self-biasing current mirror system 1. The system 1 includes (i) a current mirror 2 and (ii) a calibration circuit 3 that calibrates a biasing resistor within the current mirror. The current mirror 2 includes a reference stage 10 and first and second output stages 11, 12. The reference stage 10 includes a reference upper transistor 10T1 (reference first transistor), a reference lower transistor 10T2 (reference second transistor) and a reference resistor R, that are connected in series from a supply voltage VDD (positive voltage rail) to a reference output 10out. A reference load 10D (current reference load device) extends from the reference output 10out to ground (Gnd, or negative return line). The first output stage 11 includes a first upper transistor 11T1 (first stage first transistor) and a first lower transistor 11T2 (first stage second transistor) connected in series from VDD to a first output 11out. The second output stage 12 includes a second upper transistor 12T1 (second stage second transistor) and a second lower transistor 12T2 (second stage second transistor) connected in series from VDD to a second output 12out.

First and second output loads 11D, 12D extend respectively from the first and second outputs 11out, 12out to Gnd. The current mirror 2 controls respective output currents Iout1 and Iout2, which are respectively drawn by the first and second loads 11D, 12D from the first and second outputs 11out, 12out, to equal a reference current Iref that is drawn from the reference output 10out by the reference load 10D.

Figure 2:
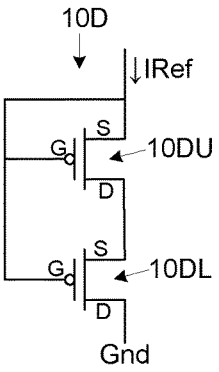
FIG. 2 is a schematic drawing of an example reference load of the system of FIG. 1.

An example of the reference load 10D is shown in FIG. 2. The reference load 10D has upper and lower transistors 10DU, 10DL (in this example FETs, more specifically pMOSFETs) whose gates G are coupled to the source S of the upper FET 10DU.

In some embodiments, the output loads 11D, 12D are an analog-to-digital converter (ADC) and a phase locked loop (PLL).

This system 1 of FIG. 1 has the following characteristics: The current mirror 2 is a cascode current mirror in that each stage 10, 11, 12 has series-connected upper and lower transistors. The transistors are the same (mutually identical, of same model) and are field effect transistors (FETs)—more specifically pMOSFETS. In each stage 10, 11, 12, the drain D (lower terminal in FIG. 1) of the first (upper) FET 10T1, 11T1, 12T1 is connected to the source S (upper terminal) of the second (lower) FET 10T2, 11T2, 12T2. The gate G (upper reference gate) of the reference first (upper) FET 10T1 is connected to both the drain D (lower reference drain) of the reference second (lower) FET 10T2 and the upper (first) terminal RU of the resistor R and has a voltage VG1. The gate G of the reference second FET 10T2 is connected to both the reference output 10out and the lower (second) terminal RL of the resistor R and has a voltage VG2. The gates G of the upper FETS 10T1, 11T1, 12T1 are interconnected, and the gates G of the lower FETS 10T2, 11T2, 12T2 are interconnected.

The current mirror circuit 2 of FIG. 1 is a wide-swing current mirror in that it can accommodate wider voltage swings of VDD, without Iout1 and Iout2 deviating from IRef, than other current mirror circuits. The current mirror circuit 2 of FIG. 1 is self-biased in that the resistor R, and not a separate prior reference stage, biases the gate of the lower reference FET 10T2.

The resistor's upper (first) terminal RU is connected to both the gate G of the reference first transistor 10T1 and the drain D of the reference second transistor 10T2. The resistor's lower (second) terminal RL has a voltage VG2 and is coupled to both the gate G of the reference second transistor 10T2 and the reference load 10D.

The resistance (resistance value) of the resistor R should be selected to help ensure that the respective source-to-drain voltage of each of the FETs 10T1, 10T2, 11T1, 11T2, 12T1, 11T2 is sufficiently high for the respective FET to operate in it saturation region (i.e., not in the triode region) for extremes of process, voltage and temperature (pvt corners).

The optimum resistance for the resistor R is a function of supply voltage VDD and temperature. In other words, the optimum resistance is different for different supply voltages VDD and different operating temperatures. For that reason, in this example, the resistance of the resistor R is variable and digitally controlled by the calibration circuit 3.

Figure 3:
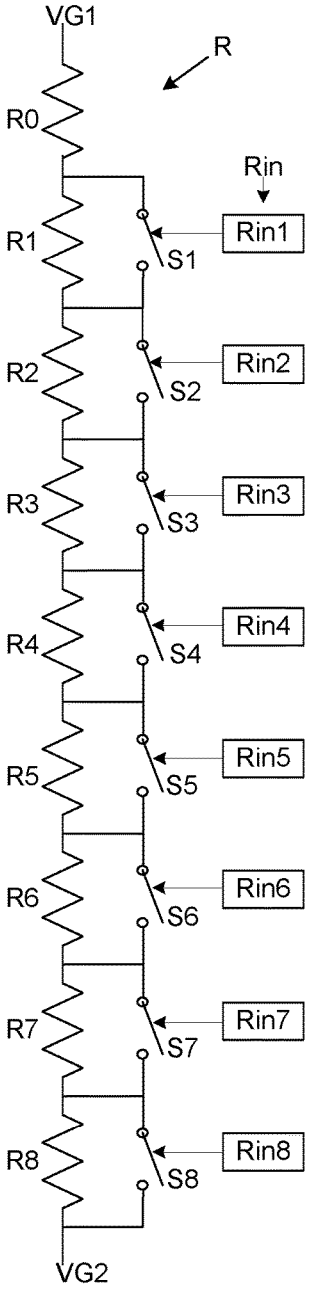
FIG. 3 is a schematic drawing of an example digitally-controlled resistor of the system of FIG. 1.

An example of the resistor R is shown in FIG. 3. The resistor R includes an 8-bit digital input Rin comprising eight digital input lines Rin1-Rin8. The resistor R further includes nine resistive elements R0-R8 connected in series. Each successive resistive element of R2-R8 has twice the resistance of the respective preceding resistive element R1-R7. Each resistive element of R1-R8 is connected in parallel with a respective shunt switch S1-S8, for example a transmission gate switch. Each shunt switch S1-S8 is controlled by a respective one of the resistor input lines Rin1-Rin8, to close the shunt switch S1-S8 and shunt the respective resistive element R1-R8 when the respective resistor input line Rin1-Rin8 goes high. Accordingly, the resistor's resistance is a function of, and controlled by, a digital input value (digital resistance-controlling value) that is applied to the resistor's input line Rin. In this example, the resistor's resistance is inversely related to the digital value at the resistor's input line Rin. Accordingly, increasing the digital input value at the resistor's input Rin, from 0 up to 255, lowers the resistor's resistance from R0+R1+ . . . +R8 down to R0.

As shown in FIG. 1, the calibration circuit 3 (calibrator) includes a reference transistor 20 (calibration FET) that is diode-connected (in that its gate G is shorted to its drain D). The reference FET's source S is connected to VDD. The reference FET's drain D outputs a current Iref with a drain voltage VD and is connected to an inverting (negative) input (−) of a comparator 21. The reference FET 20 can be the same as (identical to, same model as) the FETs 10T1, 10T2, 11T1, 11T2, 12T1, 12T2, of the current mirror 2. The comparator 21 has a non-inverting (positive) input (+) that inputs VG2 (from the gate G of the lower FET 10T2). The comparator 21 also has a power-down input PD that, when activated (selected) powers-down (turns off) the comparator 21 so that the comparator 21 will draw no (or negligible) power. Both comparator inputs are of high input-impedance and draw essentially (substantially) no current. The calibration FET 20 has a source-to-drain voltage drop that equals (is about equal to) the calibration FET's threshold voltage ($V_{th}$).

Accordingly, the comparator 21 has a first input (one of the positive and negative inputs) and a second input (the other of the positive and negative inputs) and an output 21out. The first input is coupled to the resistor's second (lower) terminal RL. The diode-connected reference transistor 20 is connected from the supply voltage VDD to the comparator's second input to apply a voltage VD at the second input.

The comparator 21 may be a conventional comparator circuit. The comparator may alternatively be a differential amplifier, an opamp or an operational transconductance amplifier (OTA, that outputs a current proportional to a difference in voltage between the OTA's two inputs).

A digital adder 31 of the calibration circuit 3 includes first and second digital 8-bit inputs 31in1, 31in2 (each input comprising eight digital input lines) and a digital 8-bit output 31out (comprising eight digital output lines). The adder's 8-bit output 31out is connected to an 8-bit input 32in of a data flip-flop 32 (DFF) which is a type of latching device. The adder 31 is configured for its digital output 31out to output a sum of the adder's two inputs 31in1, 31in2 only when an enable (EN) input of the adder 31 is activated (selected by being at a particular level).

The DFF 32 has a clock input CLK that receives a continuous clock signal 34 from a clock (not shown). The DFF 32 also includes an enable input (EN). The DFF 31 is configured to, in response to a triggering edge (e.g., upward edge and downward edge) of the clock input CLK, and only if the enable input EN is activated, cause output lines 32out of the DFF 32 to output and latch signal levels that are at input lines 32in of the DFF 32.

The DFF's 8-bit output 32out is conducted to both the resistor's 8-bit digital input Rin and to the first input 31in1 of the adder 31. A step number (step value, in this example a step number of one that is represented in binary by 00000001) is applied to the adder's second input 31in2. This can be achieved by hardwiring each line of the adder's second input 31in2 to either supply voltage VDD or ground (Gnd). Alternatively, the adder's second input 31in2 can receive signals from a calibration controller 40, such that the step number is variable and programmable. The controller 40 may be a circuit such as a processor (microprocessor). The enable inputs EN of the adder 31 and the DFF 32 are connected to the output 21out of the comparator 31.

The calibration circuit 3 performs a calibration process, of calibrating the resistance of the resistor R of the reference stage 10. The calibration process includes the following: As long as VG2 (at the comparator's positive input) exceeds the reference FET's drain voltage VD, the comparator's output 21out is high, which pulls the enable inputs EN of the adder 31 and DFF 32 high. This enables the adder 31 to output a value that equals the DFF's output plus (i.e., incremented by) the step number (00000001). On the next triggering edge (such as rising edge or falling edge) of the clock signal 34, the incremented value is output and latched at the DFF's output 32out, and fed back to the adder's first input 31in1. Accordingly, with each triggering edge of the clock signal 34, the DFF's output 32out, and thus resistor's digital input Rin, is incremented by the step number which causes an incremental decrease in the resistance of the resistor R. The DFF's output 32out (and Rin) will therefore continuously and incrementally rise, and the resistance and VG2 will continually and incrementally fall, until VG2 reaches (and drops below) VD. When VG2 reaches VD, the compactor output 21out goes low and pulls the EN inputs of the adder 31 and the DFF 32 low, which stops the incrementing and ends the calibration process. Accordingly, the comparator's output 21out changes state when the comparator's non-inverting input drops below the comparator's inverting input.

Accordingly, the reference FET 20, the comparator 21, the adder 31 and the DFF 32 together comprise an adjusting circuit that is configured to repeatedly incrementally adjust the digital resistance-controlling value to cause VG2 to approach and reach VD.

Resistive element R0 (FIG. 3) might be selected during circuit design to provide most of the required resistance, leaving switching of R1-R8 to fine tune the resistance. If the increments in resistance change are sufficiently low (corresponding to the resistance of the lowest-resistance resistive element R being sufficiently low), VG2 can be substantially equal to VD when the calibration process ends.

The controller 40 (calibration control circuit) senses that the calibration process has ended and, in response, applies control signals at PD (power down) inputs of the comparator 21 and the adder 30 to power down (turn off) the comparator 21 and the adder 31. The DFF 32 will maintain the latched output value (at 31out), thus fixing the digital resistance-controlling value at Rin until the system 1 is turned off or a new calibration process is initiated. The DFF 32 draws negligible power to maintain the latched output value, since no state transitions (in the DFF) are involved. And the comparator 21 and the adder 31 might draw no or negligible power since they are powered down.

At the start of the calibration process, the controller 40 can initially set the DFF 32 to a minimum value of zero by sending a reset signal to a reset input RST of the DFF. The controller 40 also reactivates the comparator 21 and the adder 31 by removing the power-down signal from the PD inputs.

The controller 40 can be configured to initiate a calibration process upon (in response to) any one of the following conditions (trigger events) or any combination of the following conditions (trigger events): (1) before the current mirror system 1 leaves the factory that fabricated it; (2) each time the current mirror system 1 is powered up; (3) periodically at constant time intervals; (4) each time the controller 40 senses that the supply voltage VDD has changed (or changed beyond a threshold amount); (5) each time the controller 40 senses that temperature of the current mirror system 40 has changed (or changed beyond a threshold amount). By performing the calibration at only certain times (instead of perpetually) as exemplified above, and keeping the latched output value (and thus also the resistance value) constant in-between calibrations, power is saved since the system components draw less current between calibrations than during calibrations.

Alternatively, the calibrations might be repeated continuously (non-stop) as long as the system 1 is powered by VDD.

In the above example, the adder output 31out is incremented when VG2 exceeds VD and stay constant when VG2 is less than the VD. Alternatively, the adder output 31out might be configured to be decremented if/when VG2 is less than VD. With the adder output 31out being able to both increment and decrement, the controller 40 would not have to reset the DFF output 31out to zero at the beginning of each calibration. The DFF output 32out might be stored in a static RAM that retains its value even during power down so that, when the system is powered up and starts a new calibration, the DFF output 32out will start with the same value that it had when the prior calibration ended. Also, with the adder 31 being able to both increment and decrement, the calibration might be performed continuously (without stopping) as long as the system is powered.

In the above example, the step number is constant. Alternatively, the controller 40 might set the step number to different values for different situations. For example, the controller 40 might set the step number to a higher value when incrementing and to a lower value when decrementing. In that case, the adder output 31out would first reach and exceed the optimum value in larger (coarser) steps and then decrease down to the optimum level in smaller (finer) steps.

In the above example, the adder 31 and the DFF 32 together function as a counter (counter circuit). An advantage of using a separate adder and DFF (instead of a single counter circuit) is that the adder can be turned off in-between calibrations while the DFF output remains in a latching state. Another advantage is that, unlike a counter that increments only by a step number of one, an adder enables the step number to be other than one and to be programmable and controlled by the controller 40.

Figure 4:
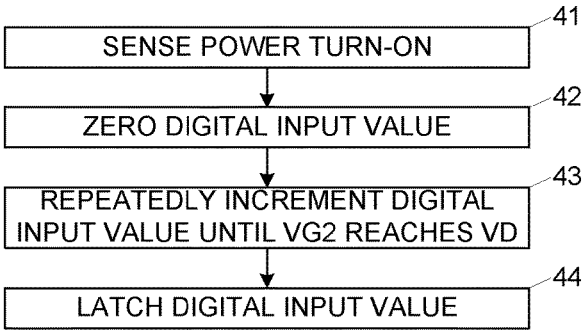
FIG. 4 is a flow chart of a method implemented by the system of FIG. 1.

FIG. 4 is a flow chart of procedural steps that that can be performed by the system 1. In operation 41, the controller 40 senses power on (the system 1 being powered), and in response initiates a calibration process as follows. In operation 42, the digital resistance-controlling value (digital input value) is initially set to zero. In operation 43, the digital input value is repeatedly incremented as long as VG2>VD, and until VG2 reaches (reaches and becomes less than) VD. Then, in operation 44, the digital input value is latched.

Figure 5:
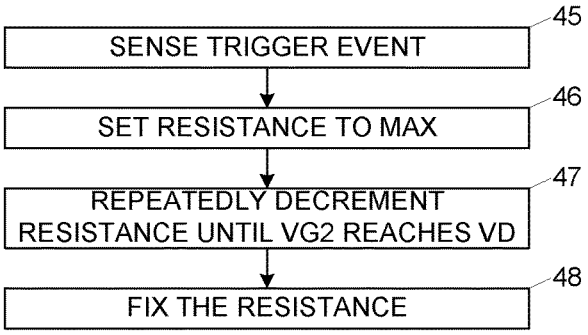
FIG. 5 is a flow chart of another method implemented by the system of FIG. 1.

FIG. 5 is a flow chart in which procedural steps are characterized differently than in FIG. 4. In operation 45, the controller 40 senses a trigger event, such as any of the trigger events mentioned above, and in response initiates a calibration process. In the calibration process, in operation 46, the resistance of resistor R is initially set to an initial value (e.g., maximum resistance that the resistor is configured to achieve). In operation 47, the resistance is adjusted (e.g., decremented) until VG2 reaches VD. Then, in operation 48, the resistance is fixed, by latching the digital resistance-controlling value that is applied to the resistor input Rin.

In some embodiments, the incrementing (and decrementing) and latching might be performed by a counter circuit, or by a circuit such as processor (microprocessor), and might be performed by the calibration controller 40 itself.

This example current mirror 2 has two output stages. Other examples might have only one output stage or might have more than two output stages.

In some embodiments, VD and VG2 are respectively fed to the comparator's positive and negative input s (which is opposite the first example), and the resistor's resistance is initially set to its lowest value (instead of the highest value as in the first example). During the calibration, the resistance is then incrementally increased (instead of decreased as in the first example) during the calibration, until VG2 reaches VD (VG2=VD or VG2>VD).

This system 1 is well suited for use in circuits in which VDD is a low voltage such as a voltage below 1.2V that leaves minimal headroom for the upper and lower FETs to operate. That is because this system 1 repeatedly (with each calibration) moves VG2 to an optimal position within the headroom so that both the upper and lower FETs might operate at saturation at all pvt corners. This may be due to the calibration FET 20 maintaining FET operation in the saturation region at all pvt corners.

Figure 6:
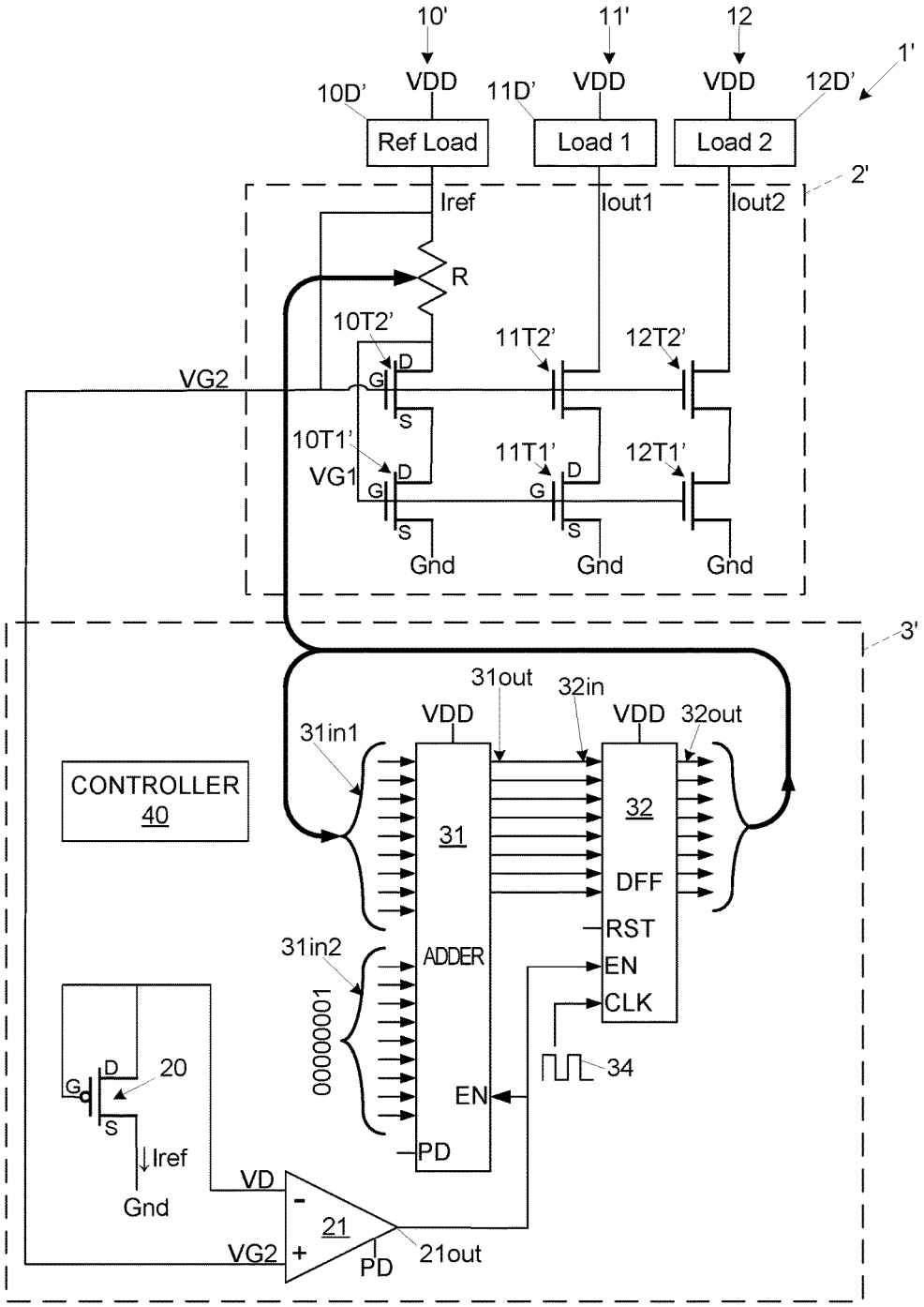
FIG. 6 is a schematic drawing of an example nMOSFET-based counterpart of the pMOSFET-based current mirror system of FIG. 1.

In the example system 1 of FIG. 1, the FETs are PMOS. A corresponding system 1', in which the FETs are NMOS, is shown in FIG. 6. Some components in the example of FIG.

6 are essentially the same as, and are labeled with same reference numerals as, corresponding components in FIG. 1. Other components in the example of FIG. 6 are NMOS counterparts of corresponding PMOS components of FIG. 1 and are labeled with prime reference numerals that match unprimed reference numerals of their FIG. 1 counterparts.

The system 1' in FIG. 6, like the system 1 in FIG. 1, has a current mirror 2' with a reference stage 10' and first and second output stages 11', 12'. Each stage 10', 11', 12' extends from a load 10D', 11D', 12D' to a ground (Gnd; negative voltage rail). The reference stage 10' has a first transistor 10T1' and a second transistor 10T2' which in this case are nMOSFETs. Similarly, each output stage 11', 12' has respective first and second transistors in this case nMOSFETs 11T1', 11T2', 12T1', 12T2'. The drain D of the reference first FET 10T1' is coupled to the source S of the reference second FET 10T2'.

In FIG. 6, the resistor R has a digital input Rin configured to input a digital resistance-controlling value, and a resistance that is a function of the digital resistance-controlling value. The resistor R has a first (lower) terminal that is connected to both a gate G of the reference first transistor 10T1' and a drain D of the reference second transistor 10T2. The resistor R has a second (upper) terminal that has a voltage VG2 and is coupled to both a gate G of the reference second transistor 10T2' and the reference load 10D.

In FIG. 6, the drains D of the output stages' upper FETs 11T1', 12T1' are coupled to output loads 11D', 12D'. The gates G of the first FETs 10T1', 11T1', 12T1' are all coupled together. Similarly, the gates G of the second FETs 10T2', 11T2', 12T2' are all coupled together. The calibration circuit 3' of FIG. 6 functions in the same ways as the calibration circuit 3 of FIG. 1. In a calibration process, the calibration circuit 3' incrementally adjusts the resistance of the resistor R until VG2 reaches, and is approximately equal to, VD.

The above description describes a system that includes a reference stage and a calibration circuit. The reference stage includes a first transistor, a second transistor and a resistor that are connected in series from a voltage rail to a reference load. The resistor has (i) a digital input that inputs a digital resistance-controlling value, (ii) a resistance that is a function of the digital resistance-controlling value, (iii) a first terminal that is coupled to both a gate of the first transistor and a drain of the second transistor, and (iv) a second terminal that has a voltage VG2 and is coupled to both a gate of the second transistor and the reference load. The calibration circuit includes a comparator that has a first input and a second input and an output. The first input is coupled to the resistor's second terminal. The calibration circuit further includes a diode-connected reference transistor that is connected from the voltage rail to the comparator's second input to apply a voltage VD at the second input, such that the comparator's output changes state when VG2 reaches VD. The calibration circuit further includes an adjusting circuit that adjusts the digital resistance-controlling value to cause VG2 to approach VD until the comparator's output changes state when VG2 reaches VD.

As explained above, the adjusting circuit may, in response to voltage VG2 reaching VD, stop the adjusting and latch the digital resistance-controlling value. The adjusting circuit may include an adder that includes a first input, a second input and an output. The adder's output outputs a value that is input by the adder's first input, and the adder's second input inputs a step number, such that the adder's output is incremented by the step number. The adjusting circuit may, before the adjusting, set the digital resistance-controlling value to a minimum value, and the adjusting of the digital resistance-controlling value may include incrementally increasing the digital resistance-controlling value. Alternatively, the adjusting circuit may, before the adjusting, set the digital resistance-controlling value to a maximum value, and the adjusting of the digital resistance-controlling value may include incrementally decreasing the digital resistance-controlling value. The adjusting circuit may further include a latching device that includes (i) a latching device input that receives the value that is output by the adder and (ii) a latching device output that, upon receiving a triggering edge of a clock signal, outputs and latches the value that is received by the latching device input. The latching device output may be connected to both the adder's first input and the resistor's digital input. The comparator and the adder may be powered down after the adjusting is stopped. The first and second transistors may be pMOSFETS, and the voltage rail may be a positive supply voltage. Alternatively, the first and second transistors may be nMOSFETS, and the voltage rail may be a ground.

The above description further describes a method performed by a calibration circuit for calibrating a reference stage. The reference stage includes a first transistor, a second transistor and a resistor that are connected in series from a voltage rail to a reference load. The resistor has (i) a digitally controllable resistance, (ii) a first terminal that is connected to both a gate of the first transistor and a drain of the second transistor, and (iiv) a second terminal that has a voltage VG2 and is coupled to both a gate of the second transistor and the reference load. The method includes sensing a trigger event and, in response, performing a calibration. The calibration includes (i) initially setting the resistance to a maximum or minimum value, (ii) adjusting the resistance until VG2 reaches a voltage VD that is output by a reference transistor that is connected to the voltage rail, and (iii) fixing the resistance after VG2 has reached VD.

The trigger event may be the reference stage being powered up. The trigger event may be the calibration circuit sensing that supply voltage has changed beyond a threshold amount, or that a temperature has changed beyond a threshold amount. The fixing of the resistance may be by latching a digital resistance-controlling value that is input by the resistor and controls the resistor's resistance.

The components and procedures described above provide examples of elements recited in the claims. They also provide examples of how a person of ordinary skill in the art can make and use the claimed invention. They are described here to provide enablement and best mode without imposing limitations that are not recited in the claims. In some instances in the above description, a term is followed by an alternative term or a substantially equivalent term enclosed in parentheses.

The invention claimed is:

1. A system comprising:

a reference stage including a first transistor, a second transistor and a resistor that are electrically connected in series from a voltage rail to a reference load, wherein the resistor has:

a digital input configured to input a digital resistance-controlling value, a resistance that is a function of the digital resistance-controlling value, a first terminal that is coupled to both a gate of the first transistor and a drain of the second transistor, and a second terminal that has a voltage VG2 and is coupled to both a gate of the second transistor and the reference load; and a calibration circuit including:

a comparator having a first input and a second input and an output, wherein VG2 is applied to the first input, a diode-connected reference transistor that is electrically connected from the voltage rail to the comparator's second input to apply a voltage VD at the second input, for the comparator's output to change state when VG2 reaches VD, and an adjusting circuit configured (i) to adjust the digital resistance-controlling value to cause VG2 to approach VD until the comparator's output changes state when VG2 reaches VD.

2. The system of claim 1, wherein the adjusting circuit is configured to, in response to voltage VG2 reaching VD, stop the adjusting and latch the digital resistance-controlling value.

3. The system of claim 2, wherein adjusting circuit includes an adder that includes a first input, a second input and an output, wherein the adder's output outputs the digital resistance-controlling value which is input by the adder's first input, and the adder's second input inputs a step number, such that the digital resistance-controlling value is incremented by the step number.

4. The system of claim 3, wherein the adjusting circuit is configured to, before the adjusting, set the digital resistance-controlling value to a minimum value, and wherein the adjusting of the digital resistance-controlling value comprises incrementally increasing the digital resistance-controlling value.

5. The system of claim 3, wherein the adjusting circuit is configured to, before the adjusting, set the digital resistance-controlling value to a maximum value, and wherein the adjusting of the digital resistance-controlling value comprises incrementally decreasing the digital resistance-controlling value.

6. The system of claim 3, wherein the adjusting circuit further includes a latching device that includes (i) a latching device input configured to receive the digital resistance-controlling value that is output by the adder and (ii) a latching device output configured to, upon receiving a triggering edge of a clock signal, output and latch the value that is received by the latching device input, and wherein the latching device output is coupled to both the adder's first input and the resistor's digital input.

7. The system of claim 3, wherein the comparator and the adder are configured to be powered down after the adjusting is stopped.

8. The system of claim 1, wherein the first and second transistors are pMOSFETS, and the voltage rail is a positive supply voltage.

9. The system of claim 1, wherein the first and second transistors are nMOSFETS, and the voltage rail is a ground.

10. The system of claim 1, wherein the adjusting circuit is a processor.

11. A system comprising:

a reference stage including a first transistor, a second transistor and a resistor that are electrically connected in series from a voltage rail to reference load, wherein the resistor has:

a digital input configured to input a digital resistance-controlling value, a resistance that is a function of the digital resistance-controlling value, a first terminal that is coupled to both a gate of the first transistor and a drain of the second transistor, and a second terminal that has a voltage VG2 and is coupled to both a gate of the second transistor and the reference load; and a calibration circuit including:

a diode-connected reference transistor whose source is coupled to the voltage rail and whose drain outputs a voltage VD, and an adjusting circuit configured to (i) adjust the digital resistance-controlling value to cause VG2 to approach and reach VD and (ii) when VG2 reaches VD, stop the adjusting and latch the digital resistance-controlling value.

12. The system of claim 11, wherein calibration circuit includes a comparator that compares VG2 to VD and an adder that adjusts the digital resistance-controlling value, and wherein the system is configured to power down the comparator and the adder after the adjusting is stopped.

13. The system of claim 11, wherein the calibration circuit is configured to perform the adjusting each time in the system is powered up.

14. The system of claim 11, wherein the calibration circuit is configured to perform the adjusting in response to the calibration circuit sensing that the supply voltage VDD has changed beyond a threshold amount.

15. The system of claim 11, wherein the calibration circuit is configured to perform the adjusting each time the system senses that a temperature has changed beyond a threshold amount.

16. A method performed by a calibration circuit for calibrating a reference stage, wherein the reference stage includes a first transistor, a second transistor and a resistor that are electrically connected in series from a voltage rail to a reference load, wherein the resistor has (i) a digitally controllable resistance, (ii) a first terminal that is coupled to both a gate of the first transistor and a drain of the second transistor, and (iiv) a second terminal that has a voltage VG2 and is coupled to both a gate of the second transistor and the reference load, the method comprising:

sensing a trigger event;

in response to sensing the trigger event, performing a calibration comprising:

initially setting the resistance to a maximum or minimum value;

adjusting the resistance until VG2 reaches a voltage VD that is output by a reference transistor that is electrically connected to the voltage rail; and fixing the resistance after VG2 has reached VD.

17. The method of claim 16, wherein the trigger event comprises the reference stage being powered up.

18. The method of claim 16, wherein the trigger event comprises the calibration circuit sensing that supply voltage has changed beyond a threshold amount.

19. The method of claim 16, wherein the trigger event comprises the calibration circuit sensing that a temperature has changed beyond a threshold amount.

20. The method of claim 16, wherein the fixing of the resistance is by latching a digital resistance-controlling value that (i) is input by the resistor and (ii) controls the resistor's resistance.

* * * * *